US005875512A

United States Patent [19]

Lathan

[11] Patent Number: 5,875,512

[45] Date of Patent: Mar. 2, 1999

[54] PERSONAL HYGIENE DEVICE

[76] Inventor: Charlene Lathan, 9214 McAfee, Houston, Tex. 77031

[21] Appl. No.: 822,744

[22] Filed: Mar. 24, 1997

[51] Int. Cl.[6] ..... A47K 10/16

[52] U.S. Cl. ..... 15/210.1; 15/176.6

[58] Field of Search ..... 15/143.1, 176.1, 15/176.6, 209.1, 210.1, 244.1; 604/1, 15, 18

[56] References Cited

U.S. PATENT DOCUMENTS

| | | | |
|---|---|---|---|
| 2,666,224 | 1/1954 | Adams | 15/210.1 |
| 2,677,842 | 5/1954 | Sherwin | 15/210.1 |
| 3,599,265 | 8/1971 | D'Ercoli | 15/210.1 |
| 4,075,033 | 2/1978 | Knox et al. | 15/210.1 |
| 4,099,289 | 7/1978 | Bretthauer . | |
| 4,256,409 | 3/1981 | Manley . | |
| 4,615,066 | 10/1986 | Colognori . | |
| 5,067,194 | 11/1991 | Rosenfeld | 15/210.1 |
| 5,127,127 | 7/1992 | Jarosinski . | |
| 5,471,701 | 12/1995 | Parfenie | 15/176.1 |

*Primary Examiner*—Terrence R. Till
*Attorney, Agent, or Firm*—Henderson & Sturm

[57] ABSTRACT

A personal hygiene device 10 for cleaning waste material from the anal/rectum area of a person. The device 10 comprises a curved handle member 20 having a push button operated detent member 35 for releasably engaging a sanitary wiping member 43 relative to the distal end 25 of the handle member 20.

7 Claims, 2 Drawing Sheets

PERSONAL HYGIENE DEVICE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of personal hygiene devices in general, and in particular to a device to allow the user to wipe their anal/rectum area.

2. Description of Related Art

As can be seen by reference to the following U.S. Pat. Nos. 4,099,289; 4,256,409; 4,615,066; and 5,127,127, the prior art is replete with myriad and diverse cleaning implements.

While all of the aforementioned prior art constructions are more than adequate for fulfilling their intended purpose and function, they are neither designed nor intended to fulfill the role played by the subject matter of the present invention.

While most able bodied individuals have never had to contend with this problem, a significant number of individuals experience a great deal of difficulty in applying normal hygienic techniques in the anal/rectum area due to physical handicaps or obesity.

As a consequence of the foregoing situation, there has existed a long standing need among physically challenged, and obese individuals, as well as with health care professionals assigned to their care, for a new type of personal hygiene device that can be employed in a quick, simple and clean manner by an individual to address their personal hygiene needs and the provision of such a construction is a stated objective of the present invention.

BRIEF SUMMARY OF THE INVENTION

Briefly stated, the personal hygiene device that forms the basis of the present invention comprises a handle unit, a spring loaded ejection unit and a sanitary wipe unit. The sanitary wipe unit is dimensioned to be received on one end of the spring loaded ejection unit.

As will be explained in greater detail further on in the specification, the handle unit has an elongated generally crescent shaped configuration to assist the user in both the placement and the back and forth movement of the sanitary wipe unit in the anal/rectum area to remove fecal matter in a well recognized fashion.

Furthermore, the spring loaded ejection unit is provided to forcibly remove the soiled sanitary wipe unit from the handle unit by the push of a button so that the used sanitary wipe unit can be discarded in the proper fashion.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2, 3:
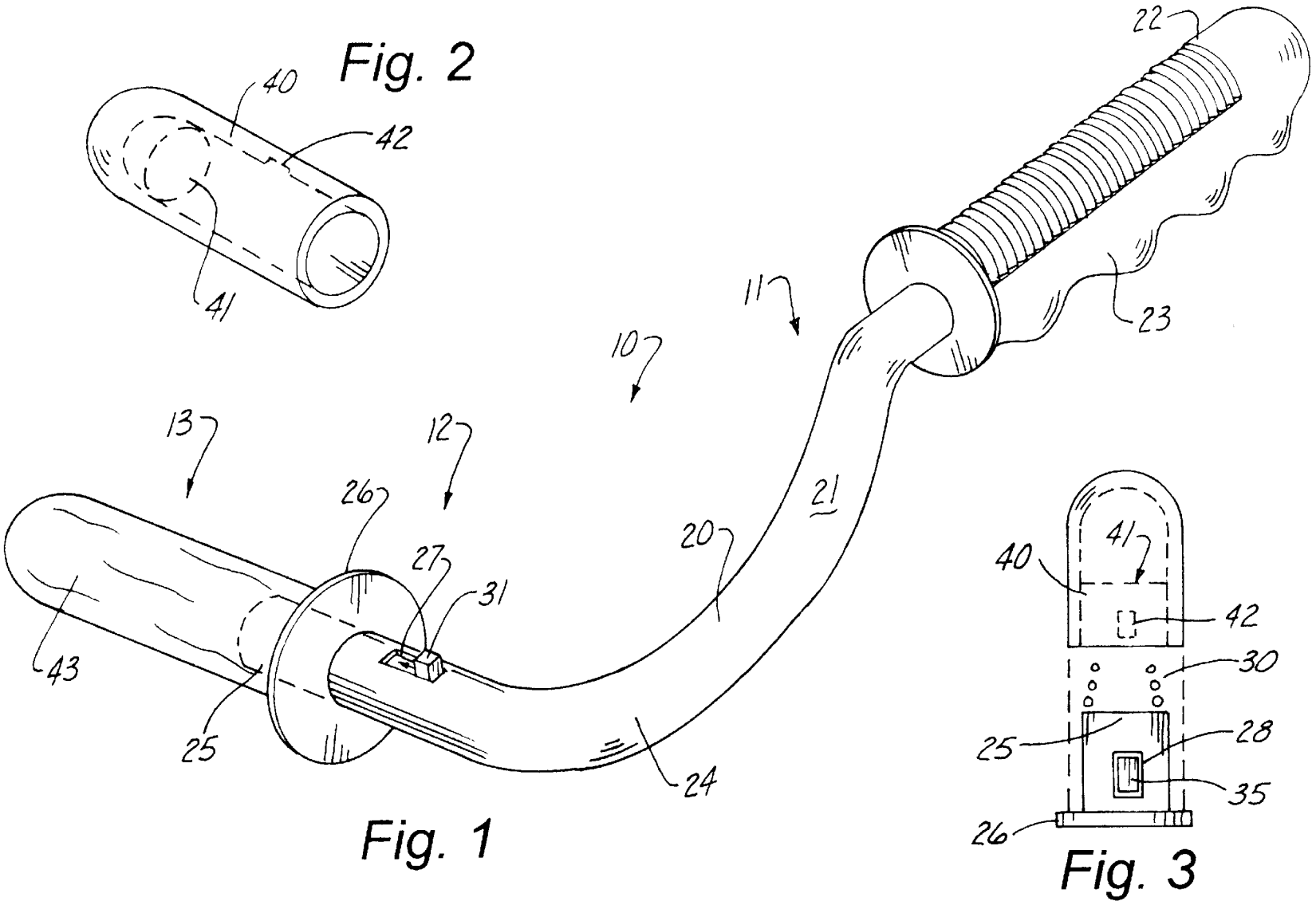
FIG. 1 is a perspective view of the personal hygiene device that forms the basis of the present invention in its assembled mode.
FIG. 2 is an isolated, detail view of the ejector ram.
FIG. 3 is an exploded view of the ejector ram and the sanitary wiper unit.

As can be seen by reference to the drawings, and in particularly to FIG. 1, the personal hygiene device that forms the basis of the present invention is designated generally by the reference number 10. The device 10 comprises in general a handle unit 11, a spring loaded ejection unit 12, and a sanitary wipe unit 13. These units will now be described in seriatim fashion.

Figure 4:
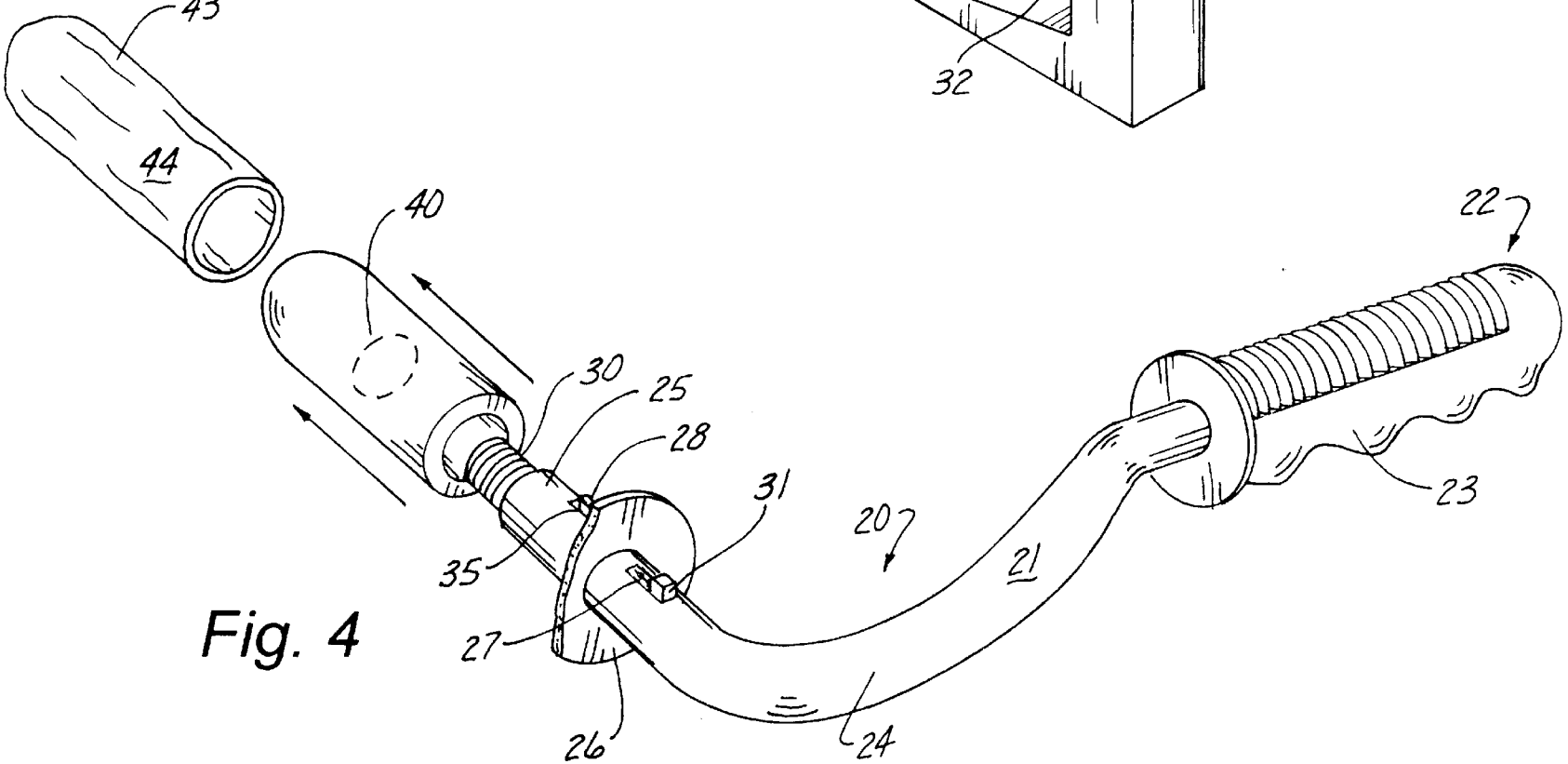
FIG. 4 is an exploded perspective view of the device.

As shown in FIGS. 1 and 4, the handle unit 11 comprises an elongated contoured tubular handle member 20 preferably fabricated from stainless steel 21 or the like wherein the proximal end 22 of the handle member 20 is provided with a rubberized handle grip element 23. In addition, the intermediate portion 24 of the handle member 20 has a generally curved configuration and terminates in the distal end 25 of the handle member 20 which will be described presently.

Figure 5:
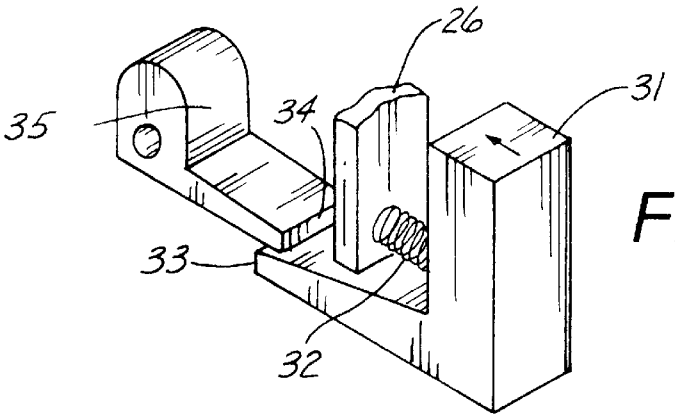
FIG. 5 is an isolated detail view of the ejector latch mechanism.

As can best be seen by reference to FIGS. 3 through 5, the spring loaded ejection unit 12 comprises an ejection spring member 30 dimensioned to be received within the distal end 25 of the handle member 20. The distal end 25 of the handle member 20 is further provided with a peripheral collar element 26 disposed intermediate a push button aperture 27 and a detent aperture 28 whose purpose and function will be described presently.

In addition, the actuation of the ejection spring member 30 is controlled by a push button member 31 which is spring biased away from an interior portion of the handle collar element 26 by spring element 32 wherein the leading edge 33 of the push button member 31 is operatively engaged with the trailing edge 34 of a detent member 35 which is pivotally secured in the distal end 25 of the handle member 20. Furthermore, the push button member 31 and the detent member 35 normally project outwardly through the push button aperture 27 and the detent aperture 28 respectively, when the ejector spring member 30 is in its relaxed state.

Turning now to FIGS. 2 through 4, it can be seen that the sanitary wipe unit 13 comprises an inner generally tubular support member 40 provided with an interior, transverse spring bearing surface 41 and an interior peripheral recess 42, and an outer sanitary wipe member 43 fabricated from sterile cotton 44 or the like.

In operation, the user would insert the tubular support member 40 over the distal end 25 of the handle member 20 wherein the spring bearing surface 41 would compress the ejection spring member 30 until the detent 35 is received within the peripheral recess 42 in the support member 40. At this point, the sanitary wipe member 43 would be placed over the support member 40 and used in the manner as outlined herein to clean the user's anal/rectum areas of fecal matter or the like.

After the device 10 has been employed in its intended manner, the user would then dispose of the sanitary wipe member 43 and the tubular support member 40 by actuating the push button 31 to release the detent 35 from the recess

42 in the support member 40 to forcibly disengage the sanitary wipe unit 13 from the remainder of the device 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A personal hygiene device for wiping clean a person's rectum/anal area wherein the device comprises:

a handle member having a distal end provided with an ejection spring member, a proximal end, and a curved intermediate portion;

a sanitary wipe unit including a sanitary wipe member operatively associated with the distal end of said handle member; and means for disengaging the sanitary wipe member from the distal end of said handle member.

2. The personal hygiene device as in claim 1 wherein the proximal end of the handle member is provided with a handle grip element.

3. The personal hygiene device as in claim 1 wherein the sanitary wipe unit also includes a tubular support member dimensioned to be received within said sanitary wipe member.

4. The personal hygiene device as in claim 3 wherein said tubular support member is dimensioned to receive at least a portion of said ejection spring member.

5. The personal hygiene device as in claim 4 wherein the interior of said tubular support member is provided with a transverse spring bearing element and a peripheral recess.

6. The personal hygiene device as in claim 5 wherein said means comprises in part a detent member dimensioned to be received in said peripheral recess and operatively disposed on the distal end of the handle member.

7. The personal hygiene device as in claim 6 wherein said means further comprises a push button member also disposed on the distal end of the handle member, and operatively associated with the detent member for retracting the detent member relative to the external periphery of said distal end.

* * * * *